US005209303A

United States Patent [19]

Barrington

[11] Patent Number: 5,209,303

[45] Date of Patent: May 11, 1993

[54] COMPRESSIBLE LIQUID MECHANISM FOR DOWNHOLE TOOL

[75] Inventor: Burchus Q. Barrington, Duncan, Okla.

[73] Assignee: Halliburton Company, Duncan, Okla.

[21] Appl. No.: 795,347

[22] Filed: Nov. 20, 1991

[51] Int. Cl.[5] ..... E21B 34/10

[52] U.S. Cl. ..... 166/374; 166/321; 166/323

[58] Field of Search ..... 166/321, 373, 374, 378, 166/264, 319, 323

[56] References Cited

U.S. PATENT DOCUMENTS

| | | | |
|---|---|---|---|
| 4,109,724 | 8/1978 | Barrington | 166/315 |
| 4,109,725 | 8/1978 | Williamson et al. | 166/315 |
| 4,311,197 | 1/1982 | Hushbeck | 166/373 |
| 4,444,268 | 4/1984 | Barrington | 166/373 |
| 4,448,254 | 5/1984 | Barrington | 166/373 |
| 4,489,786 | 12/1984 | Beck | 166/374 |
| 4,515,219 | 5/1985 | Beck | 166/374 |
| 4,537,258 | 8/1985 | Beck | 166/374 |
| 4,557,333 | 12/1985 | Beck | 166/374 |
| 4,617,999 | 10/1986 | Beck | 166/372 |
| 4,664,196 | 5/1987 | Manke | 166/378 |
| 4,665,991 | 5/1987 | Manke | 166/373 |
| 4,691,779 | 9/1987 | McMahan et al. | 166/321 |

*Primary Examiner*—Ramon S. Britts
*Assistant Examiner*—Frank S. Tsay
*Attorney, Agent, or Firm*—James R. Duzan; L. Wayne Beavers

[57] ABSTRACT

An annulus pressure responsive downhole tool includes a housing with a power piston slidably disposed therein. First and second pressure conducting passages communicate a well annulus exterior of the housing with first and second sides of the power piston. A flow restrictor is disposed in the second pressure conducting passage so that a relatively rapid increase in well annulus pressure creates a pressure differential across the power piston to move the power piston. A volume of silicone oil is contained in a first portion of the second pressure conducting passage between the second side of the power piston and the flow restriction, for accommodating displacement of the power piston as it moves. An operating element is disposed in the housing and movable from an initial position to a final position. The operating element is associated with the power piston so that the power piston moves the operating element from its initial position to an intermediate position. A second stage power device is provided for moving the operating element from its intermediate position to its final position without further compressing the volume of silicone oil contained in the tool.

26 Claims, 3 Drawing Sheets

COMPRESSIBLE LIQUID MECHANISM FOR DOWNHOLE TOOL

BACKGROUND OF THE INVENTION

1. Field Of The Invention

The present invention relates generally to downhole tools for use in oil and gas wells, and more particularly, but not by way of limitation, to downhole tools operated in response to a change in well annulus pressure.

2. Brief Description Of The Prior Art

The prior art includes many downhole tools which are operated in response to annulus pressure. One system utilizes a compressed nitrogen gas spring within the tool to accommodate displacement of a differential pressure piston which moves in response to changes in well annulus pressure. The differential pressure across the power piston is developed by placing a fluid flow restriction in a flow channel communicating one side of the power piston with the well annulus, while there is free communication between the other side of the power piston and the well annulus. Typical examples of such a system as applied to a combination closure and circulation valve are shown in U.S. Pat. No. 4,691,779 to McMahan et al., and U.S. Pat. No. 4,311,197 to Hushbeck.

One disadvantage of tools of the type utilizing a compressed nitrogen gas spring within the tool is that the nitrogen gas must be placed in the tool under pressure before the tool is lowered into a well.

One attempt to eliminate the need for pressurizing the tool has been to replace the compressed nitrogen gas spring with a compressed liquid spring, typically silicone oil. Typical examples of annulus pressure responsive tools utilizing a silicone oil liquid spring are seen in U.S. Pat. Nos. 4,448,254 and 4,444,268 to Barrington.

One disadvantage of tools utilizing a compressible silicone oil spring chamber to accommodate displacement of the differential pressure power piston is that a relatively large volume of silicone oil must be provided to provide sufficient volume change at typical operating pressures to accommodate the displacement of the power piston. These large oil volumes make the tool undesirably large, heavy and bulky to handle.

Thus, there is a need for an annulus pressure responsive tool actuation system which avoids both the necessity of pressurizing the tool internally with high pressure gas while also avoiding the extremely large tool sizes which have previously been necessary to accommodate compressible silicone oil liquid springs.

SUMMARY OF THE INVENTION

The present invention provides an actuation system for an annulus pressure responsive downhole tool which overcomes both of the disadvantages just mentioned. This system utilizes a primary power piston, and a second stage power means which may be a second differential pressure power piston or other power means. The primary power piston acts against a relatively small compressible oil spring chamber to accomplish a first portion of movement of an operating element of the tool. The second stage power means then accomplishes the remainder of the operating movement of the tool without any further compression of the compressible oil spring chamber.

More specifically such an annulus pressure responsive downhole tool includes a housing with a first power piston slidably disposed in the housing and having first and second sides. First and second pressure conducting passages are defined in the housing for communicating a well annulus exterior of the housing with the first and second sides of the first power piston.

A retarding means, such as a fluid flow restriction, is disposed in the second pressure conducting passage for delaying communication of a sufficient portion of a relatively rapid increase in well annulus pressure to the second side of the first power piston for a sufficient time to allow a pressure differential across the first power piston to move the first power piston between a first position and a second position relative to the housing.

A compressible liquid spring chamber is defined in a first portion of the second pressure conducting passage between the second side of the first power piston and the retarding means, for accommodating displacement of the first power piston from its first position to its second position.

An operating means such as a ball type flow valve and/or a circulating valve is disposed in the housing and movable from an initial position to a final position. The operating means is associated with the first power piston so that as the first power piston moves from its first position to its second position, the operating means is moved from its initial position to an intermediate position between its initial position and its final position. For example, if the operating means is a spherical ball flow valve, that flow valve may have an initial open position and a final closed position. The movement of the first power piston would begin movement of the spherical ball valve from its open position toward, but not entirely to, its final closed position.

A second stage power means, which may be a second differential pressure power piston or which may be other mechanical power supply means, further moves the operating means such as the spherical ball valve from its intermediate position on to its final position without further compressing the compressible liquid spring.

Thus, the advantage of using a compressible liquid spring so as to avoid the need for pressurizing a tool internally with gas before the tool is placed in a well, is provided without the disadvantage of the extremely large compressible liquid spring chamber volumes required in previous tools.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1A:
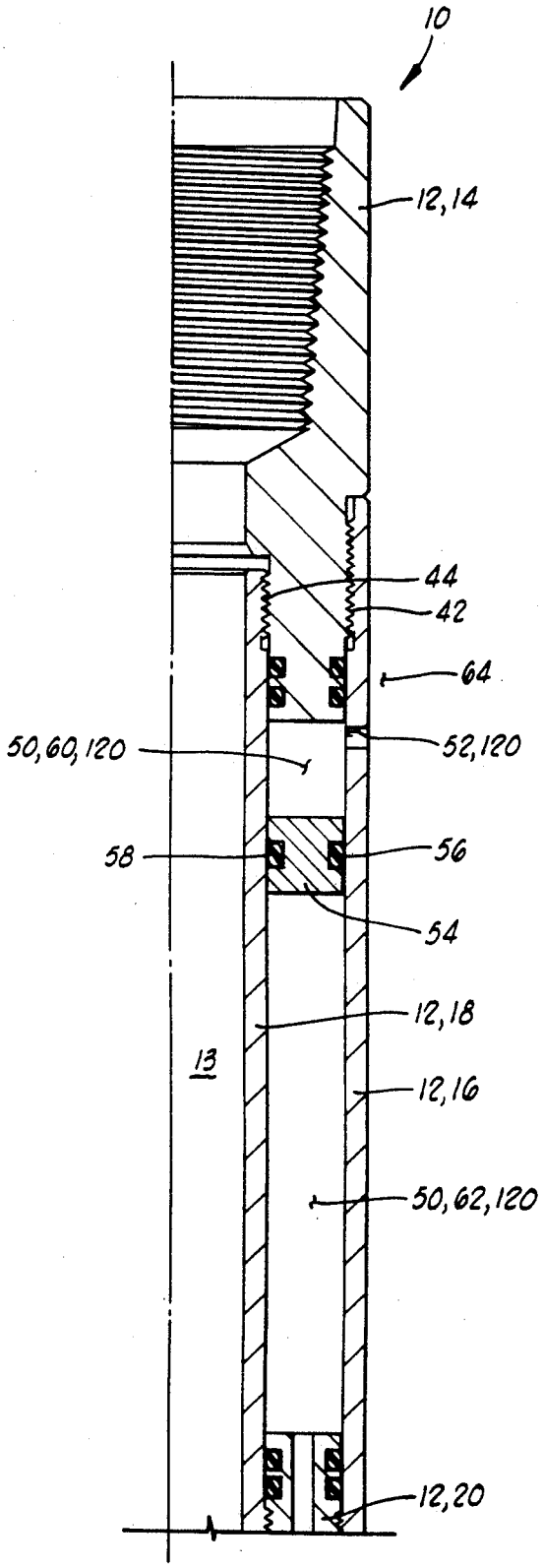
FIGS. 1A–1F comprise an elevation right-side only, sectioned illustration of a full opening safety circulating valve incorporating the actuating mechanism of the present invention.
Figure 1B:
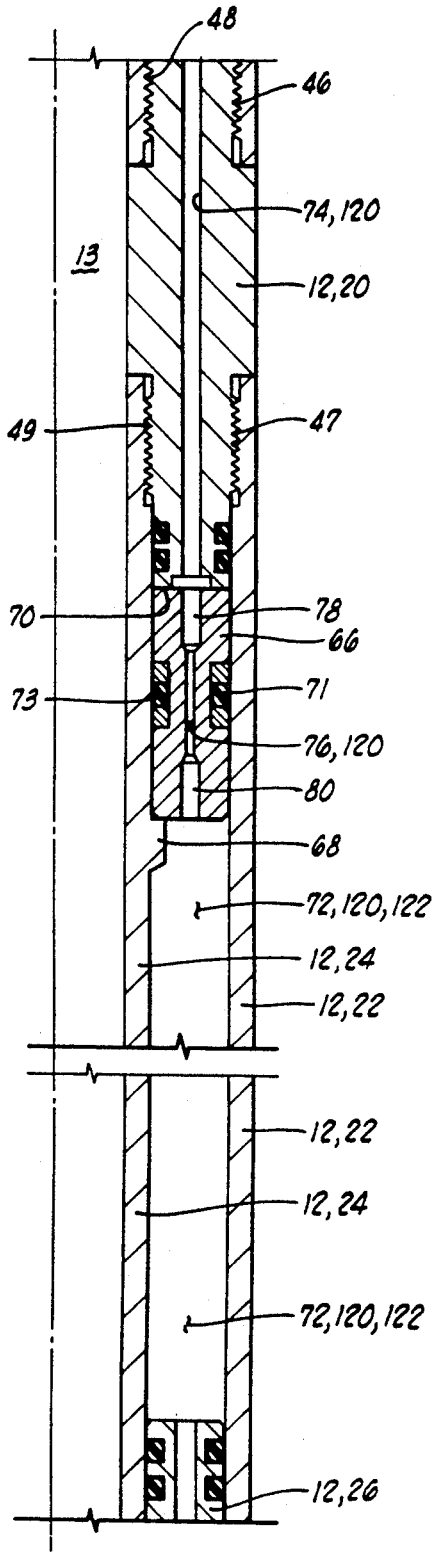

An annulus pressure responsive downhole tool apparatus is shown and generally designated by the numeral 10. The apparatus shown is a full opening safety circulating valve.

Safety circulating valves are commonly used in a well testing string where it is desired to test the production capabilities of a formation. A testing string is lowered into the bore hole of a well to the formation depth and the formation fluid is allowed to flow into the string in a controlled testing program. A typical testing string including a safety circulating valve is shown for example in U.S. Pat. No. 4,311,197 to Hushbeck, the details of which are incorporated herein by reference.

The tool 10 includes a housing generally designated by the numeral 12. Housing 12 has a housing bore 13 defined longitudinally therethrough. The housing 12 includes from top to bottom an upper adapter 14, an upper outer oil chamber housing section 16, an upper inner oil chamber housing section 18, a first intermediate adapter 20, a intermediate outer oil chamber housing section 22, a intermediate inner oil chamber housing section 24, a second intermediate adapter 26, a lower outer oil chamber housing section 28, a primary power housing section 30, a collet housing section 32, a ball valve housing section 34, a lower adapter 36, an upper seat holder mandrel 38, and a lower seat holder mandrel 40.

The upper adapter 14 is threadedly connected to outer and inner upper oil chamber housing sections 16 and 18 at threaded connections 42 and 44, respectively. Lower ends of the upper outer and inner oil chamber housing sections 16 and 18 are threadedly connected to first intermediate adapter 20 at threads 46 and 48, respectively.

An annular upper oil chamber 50 is defined between outer and inner upper oil chamber housing sections 16 and 18. An equalizing port 52 is defined through upper outer oil chamber housing section 16 near an upper end of upper oil chamber 50. A first floating piston 54 is received in upper oil chamber 50 and has outer and inner O-rings 56 and 58 which provide sliding seals against outer and inner upper oil chamber housing sections 16 and 18, respectively.

The floating piston 54 divides the upper oil chamber 50 into an upper portion 60 and a lower portion 62. The upper portion 60 is filled with well fluid, typically mud, which enters the equalizing port 52 from a well annulus 64 which surrounds the tool 10 when the tool 10 is in place within the bore hole of a well. Floating piston 54 separates the well fluid in upper chamber portion 60 from a compressible liquid, preferably silicone oil, contained in lower chamber portion 62.

First intermediate adapter 20 is threadedly connected to outer and inner intermediate oil chamber housing sections 22 and 24 at threads 47 and 49.

An annular metering cartridge 66 is located between outer and inner intermediate oil chamber housing sections 22 and 24. A radially outward extending ledge 68 on inner intermediate oil chamber housing section 24 holds the metering cartridge 66 tightly against a lower end 70 of first intermediate adapter 20 when the threaded connection 49 is made up.

Outer and inner O-ring seals 71 and 73 seal between the metering cartridge 66 and the outer and inner intermediate oil chamber housing sections 22 and 24, respectively.

An intermediate oil chamber 72 is defined between outer and inner intermediate oil chamber housing sections 22 and 24.

The first intermediate adapter 20 has one or more longitudinal passages 74 disposed therethrough which communicate the upper oil chamber 50 with the metering cartridge 66. Metering cartridge 66 has a pressurizing passage 76 disposed therethrough which communicates the passage 74 with the intermediate oil chamber 72.

The pressurizing passage 76 has a fluid flow restrictor 78 disposed therein which may be a Visco-Jet TM flow restrictor available from the Lee Company. Pressurizing passage 76 also has a back pressure check valve 80 disposed therein which permits flow of silicone oil downward through pressurizing passage 76 when the downward pressure differential across back pressure check valve 80 exceeds a predetermined level. The metering cartridge 66 also has a depressurizing passage (not shown) disposed therethrough having a second back pressure check valve (not shown) located therein which allows flow of oil upward from intermediate oil chamber 72 to the upper oil chamber 50 if an upward pressure differential thereacross exceeds the preset value of the back pressure check valve in the depressurizing passage.

The lower ends of the outer and inner intermediate oil chamber housing sections 22 and 24 are connected to second intermediate adapter 26 at threaded connections 82 and 84, respectively. One or more longitudinal passages 86 are defined downwardly through second intermediate adapter 26.

An upper operating mandrel 88 is slidably received in housing 12. The upper operating mandrel 88 has an upper end 90 and a lower end 92. An upper end portion of upper operating mandrel 88 is closely received within a counterbore 94 of second intermediate adapter 26 with O-ring seals 96 being provided therebetween. A lower end portion of upper operating mandrel 88 is closely received within a bore 98 of primary power housing section 30 with O-ring seals 100 being provided therebetween.

An irregular annular lower silicone oil chamber 102 is defined between lower outer oil chamber housing section 28 and the upper operating mandrel 88.

A first power piston 104 is slidably received within a counterbore 106 of primary power housing section 30, with sliding O-ring seals 108 being provided therebetween. First power piston 104 has a lower first side 110 and an upper second side 112. The first side 110 is communicated with the outside well annulus 64 through a power port 114 defined through the primary power housing section 30. Power port 114 communicates with an annular space 116 defined between primary power housing section 30 and the upper operating mandrel 88 immediately below the primary power piston 104.

The housing 12 can be described as having first and second pressure conducting passage means 118 and 120, respectively, for communicating the well annulus 64 exterior of the housing 12 with the first and second sides 110 and 112, respectively, of first power piston 104. The first pressure conducting passage means 118 includes power port 114 and annular space 116. The second pressure conducting passage means 120 includes equalizing port 52, upper oil chamber 50, passage 74, pressurizing passage 76, intermediate oil chamber 72, passage 86, and lower oil chamber 102.

The metering cartridge 66, and particularly the fluid flow restrictor 78 disposed therein can be generally described as a retarding means 78 disposed in the second pressure conducting passage means 120 for delaying communication of a sufficient portion of a relatively rapid change in well annulus pressure to the second side 112 of first power piston 104 for a sufficient time to allow a pressure differential across the first power piston 104 to move the first power piston 104 upward from a first position as shown in FIG. I to a second position which is further described below.

The metering cartridge 66 is constructed in a manner similar to that of the various other annulus pressure responsive downhole tools referred to above. Due to the fluid flow restriction 78 in the pressure conducting passage 120 on one side of the power piston, rapid increases or decreases in well annulus pressure are not immediately felt on that side of the power piston. Thus, a rapid change in well annulus pressure will create a pressure differential across the power piston which can be utilized to actuate the tool. Relatively slow changes in well annulus pressure, on the other hand, such as those encountered as the tool 10 is run into the well on a tool string are communicated through the pressurizing passage 76 quickly enough that the first power piston 104 remains relatively balanced and does not actuate the tool prematurely. After the tool is located at an operating depth within the well, within a short period of time the well annulus pressure will be balanced across the first power piston 104 except for any relatively small difference provided by back pressure check valves in the metering cartridge 66. Then when it is desired to operate the tool, the well annulus pressure can be rapidly increased thus creating a temporary upward pressure differential across first power piston 104 causing it to move upward to actuate the tool 10 in a manner further described below.

As the first power piston 104 moves upward within housing 12 it will decrease the volume of the lower oil chamber 102. The silicone oil contained in lower oil chamber 102, passageway 86 and upper oil chamber 72 can be collectively defined as a compressible liquid means 122 contained in a first portion 122 of the second pressure conducting passage means 120 between the second side 112 of first power piston 104 and the fluid flow restrictor 78. This compressible liquid means 122 provides a means for accommodating displacement of the power piston 104 from the first position shown in FIG. 1 to a second position wherein power piston 104 is moved upward relative to housing 12. This accommodation is accomplished by the fact that the silicone oil is compressible and it will compress and allow the power piston 104 to move upward when subjected to the pressure applied by the power piston 104 due to increased pressure in the well annulus 64.

The necessary volume of silicone oil to accommodate any given displacement of power piston 104 under given pressure and temperature conditions can be determined from available data such as that presented in U.S. Pat. No. 4,109,724 to Barrington at FIG. 2 thereof, the details of which are incorporated herein by reference.

The tool 10 also includes a lower operating mandrel assembly 124 which includes an upper part 126, an intermediate part 128 connected to upper part 126 at thread 130, and a lower part 132. As will be further described below, the lower operating mandrel assembly 124 moves longitudinally as a unit relative to housing 12. A second power piston 134 has a groove 136 defined therein which receives radially inward extending flange 138 of lower part 132 of lower operating mandrel assembly 124 so that the second power piston 134 also moves as a unit with the lower operating mandrel assembly 124.

As seen in FIG. ID, the upper part 126 of lower operating mandrel assembly 124 has an upper end 140 which freely abuts the lower end 92 of upper operating mandrel 88.

The intermediate part 128 of lower operating mandrel assembly 124 includes an annular ring 142 having a plurality of integral arms 144 extending upwardly therefrom through arcuate openings 146 in a centralizing ring 148 attached to the upper end of upper seat holder mandrel 38 at thread 150. Annular ring 142 has a bore 152 therethrough through which the upper seat holder mandrel 38 is freely slidably received. Annular ring 142 has a groove 154 defined therein within which is received a radially inward extending flange 156 of lower part 132 of lower actuating mandrel assembly 124.

The upper seat holder mandrel 138 carries an annular upper valve seat 158 in a counterbore 160 thereof with an O-ring seal 162 being provided therebetween. A Belleville spring 164 biases the upper seat 158 against a spherical ball valve member 166. The ball valve member 166 also sealingly engages a lower annular seat 168 which is carried by the lower seat holder mandrel 48.

The spherical ball valve element 166 has a valve bore 170 defined therethrough. In the open initial position of ball valve element 166 seen in FIG. 1E, the valve bore 170 is aligned with the housing bore 13 of housing 12 so that the housing bore 13 is fully open therethrough.

Figure 1C:
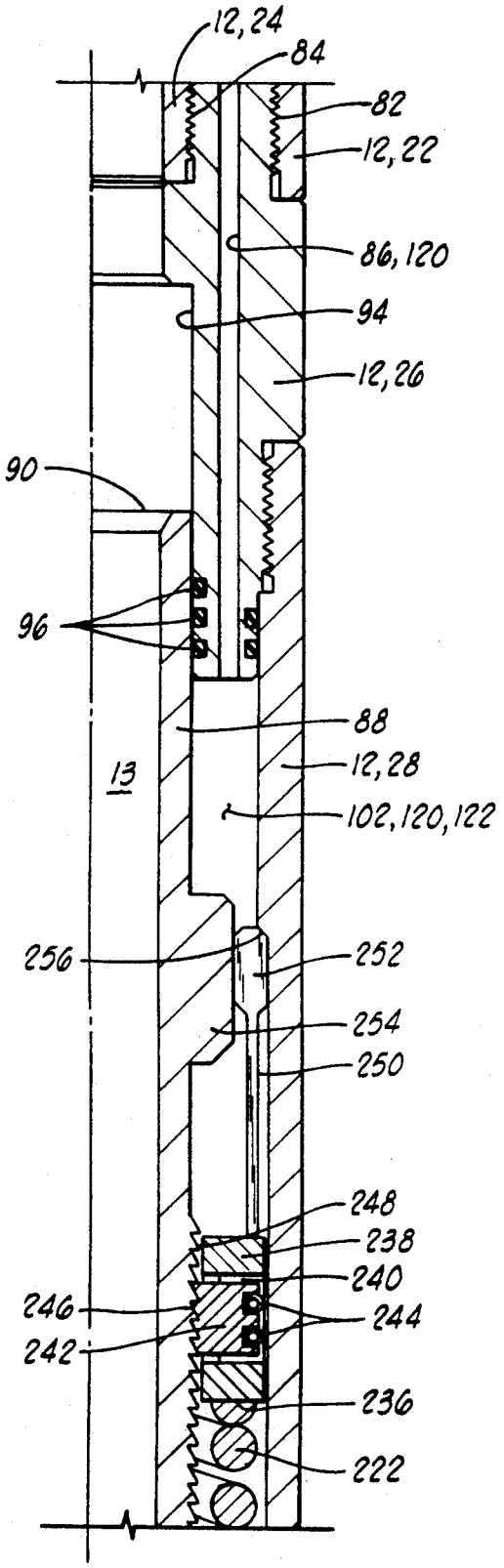
Figure 1D:
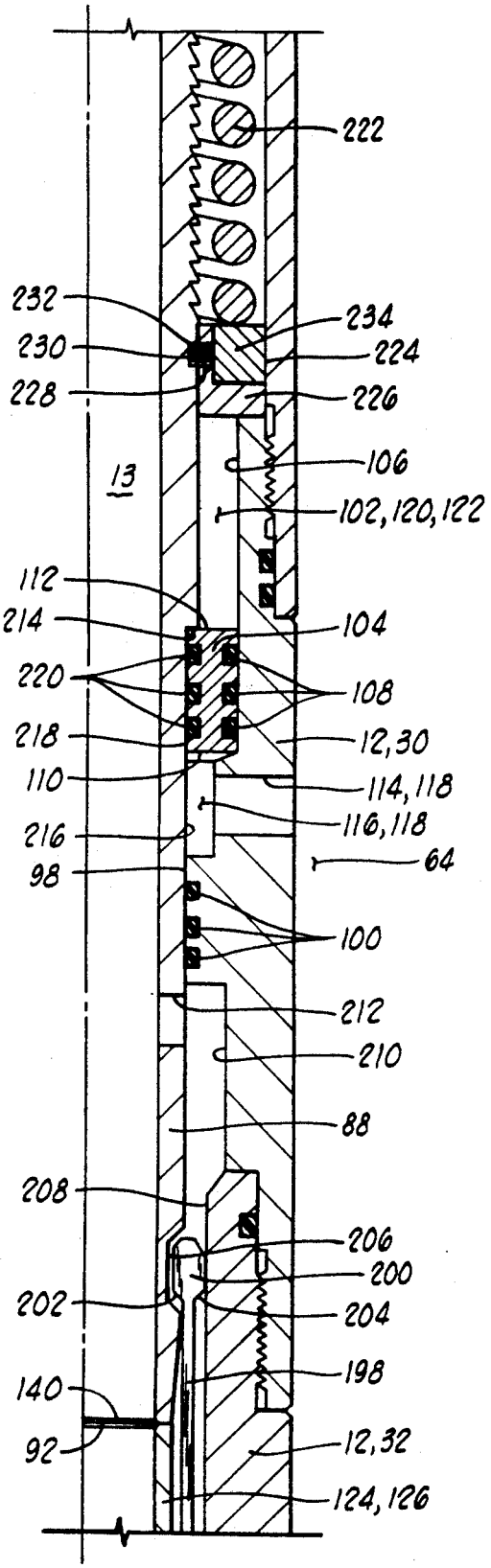
Figure 1E:
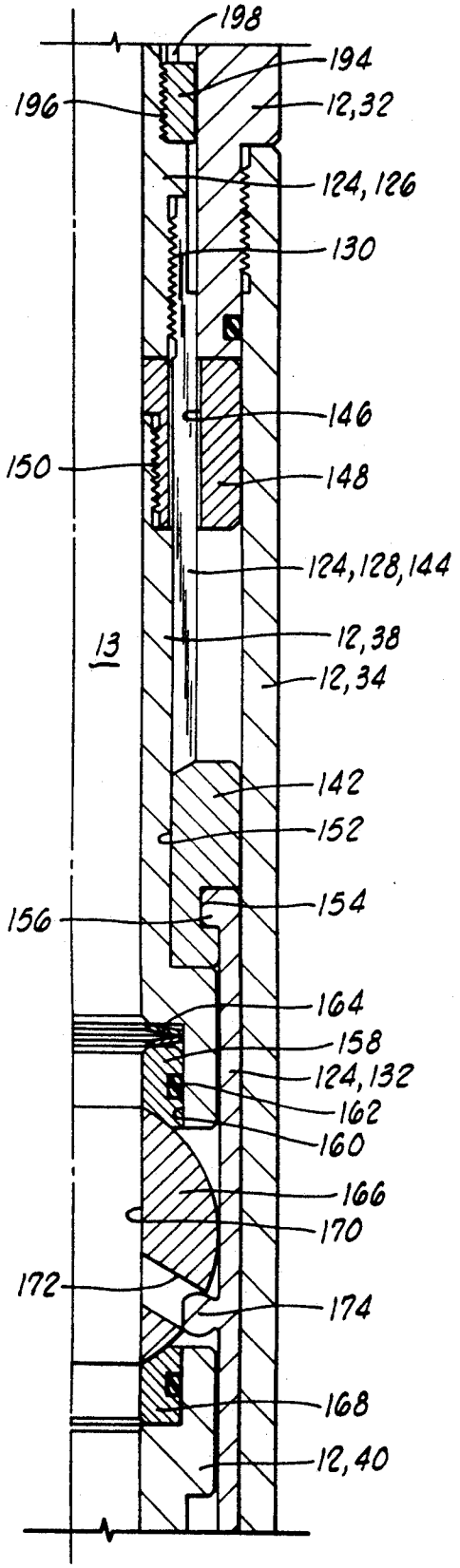

Spherical ball valve element 166 has a pair of eccentric bores 172 defined therein, only one of which is visible in FIG. 1E. The lower part 132 of lower actuating mandrel assembly 124 carries an actuating lug 174 which is received within eccentric bore 172. The spherical ball valve element 166 is longitudinally fixed in position relative to housing 12. When the lower operating mandrel assembly 124 moves upward relative to housing 12 in a manner further described below, the engagement of lug 174 with eccentric bore 172 will rotate the ball valve element 166 to a final position, rotated 90° from that shown in FIG. 1E, wherein the valve bore 170 is isolated from housing bore 13 thus closing the housing bore A second stage power port 176 is defined through the ball valve housing section 34 near a lower end of an annular lower power chamber 178 defined between ball valve housing section 34 and the lower seat holder mandrel 40.

The second stage power piston 134 is annular in shape and is closely received within the lower power chamber 178 with upper and lower outer sliding O-ring seals 180 and 182, respectively, sealing between second power piston 134 and a cylindrical bore 184 of ball valve housing section 34. Second power piston 134 includes a piston bore 186 which is closely and slidably received about an outer cylindrical surface 188 of lower seat holder mandrel 40 with a sliding O-ring seal 190 provided therebetween.

Figure 1F:
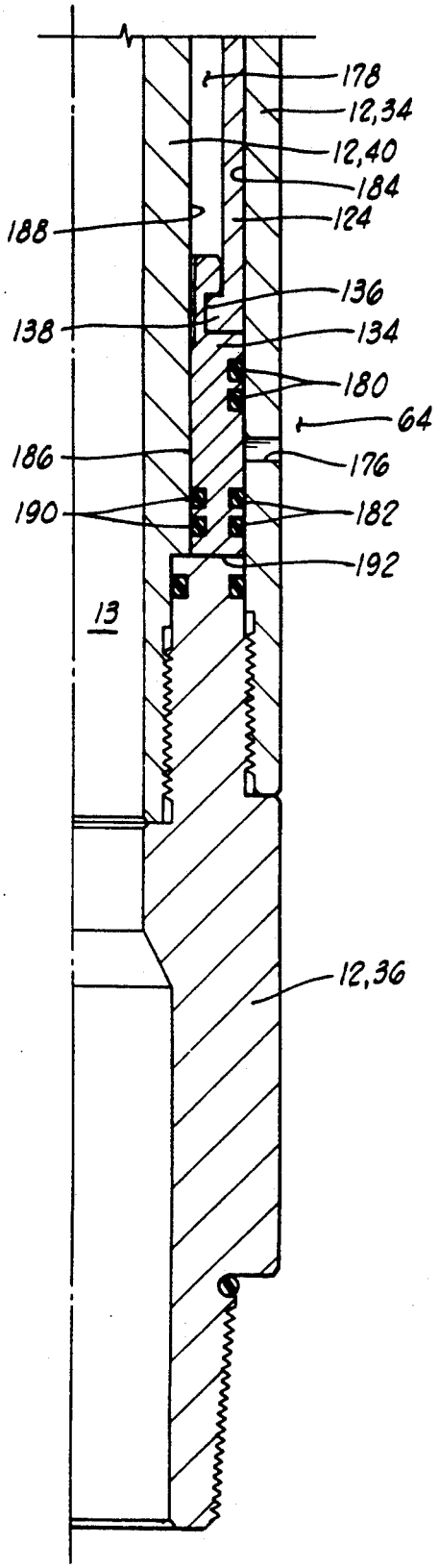

When the second power piston 134 is in its initial position shown in FIG. 1F, the upper and lower outer O-ring seals 180 and 182, respectively, are located above and below the second power port 176 thus isolating a high pressure side 192 of second power piston 134 from the well annulus 64. As the second power piston 134 moves upward relative to housing 12 in a manner further described below, the lower sliding seals 182 will pass above second power port 176 thus communicating the high pressure side 192 of second power piston 134 with the well annulus 64 through the second power port 176, at which point an upward pressure differential which then acts across the second power piston 134 will assist in moving the lower power mandrel assembly 124 upward relative to housing 12 thus completing the closing movement of the spherical ball valve element 166.

The upper part 126 of lower operating mandrel assembly 124 has a collet ring 194 threadedly attached thereto at 196 as seen in FIG. 1E. A plurality of collet fingers 198 extend upward therefrom and terminate in enlarged ends 200. The enlarged end 200 has a radially inward extending tapered surface 202 defined thereon and a radially outward extending tapered surface 204 defined thereon.

In the initial position of the tool 10 as seen in FIG. 1D, the enlarged end 200 is received within a groove 206 defined in the radially outer surface of the lower portion of upper operating mandrel 88.

The collet fingers 198 are constructed so that they are resiliently outwardly biased when held in the position shown in FIG. 1D. The enlarged ends 200 engage a bore 208 of collet housing seat 32 when the tool 10 is in its initial position. As the upper operating mandrel 88 and lower operating mandrel assembly 124 slide upward relative to housing 12, the enlarged ends 200 will eventually be allowed to spring radially outward into a counterbore 210 of primary power housing section 30. It will be appreciated that when the collet finger ends 200 are held in place within groove 206 as shown in FIG. ID, the upper operating mandrel 88 and the lower operating mandrel assembly 124 are releasably latched together for common movement longitudinally relative to housing 12. After they have moved upwardly sufficient so that the enlarged ends 200 can spring out of engagement with the groove 206, the upper operating mandrel 88 is released from the lower operating mandrel assembly 124. At that point in time the upper operating mandrel assembly may, but probably will not, move upward out of engagement with lower operating mandrel assembly 124. As seen in FIG. ID, the lower end 92 of upper operating mandrel 88 is in free abutting engagement with the upper end 140 of upper part 126 of lower operating mandrel assembly 124.

The upper operating mandrel 88 has a circulating port 212 defined therethrough. In the initial position of upper operating mandrel 88 as seen in FIG. ID, the circulating port 212 is located below the seals 100 so that circulating port 212 is isolated from the primary power port 114. As upper operating mandrel assembly 88 moves upward relative to housing 12, the circulating port 212 will eventually move above the uppermost seal 100 thus placing circulating port 212 in fluid communication with the well annulus 64 through the annular space 116 and the primary power port 114.

The upper operating mandrel 88 has a power transfer shoulder 214 defined thereon facing away from the compressible liquid means 122. The upper operating mandrel 88 has a reduced diameter cylindrical outer surface 216 defined thereon below shoulder 214.

The primary power piston 104 has a cylindrical bore 218 therethrough which is closely received about cylindrical outer surface 216 with a plurality of sliding O-ring seals 220 sealing therebetween.

In the initial position of the tool 10 as seen in FIG. 1D, the primary power piston 104 abuts the power transfer shoulder 214 of upper operating mandrel 88. Thus, when well annulus pressure is rapidly increased, the upward acting pressure differential across primary power piston 104 will be transferred to the upper operating mandrel 88 due to the abutting engagement of power piston 104 with the power transfer shoulder 214.

As further described below, the primary power piston 104 will initiate movement of both the upper operating mandrel 8 and the lower operating mandrel assembly 124. It will move those components to an intermediate position between their initial and final positions, at which time a second stage power means will take over to complete the movement of the circulating port 212 to its final open position and of the spherical ball valve element 166 to its final closed position.

In the embodiment illustrated in FIGS. 1A-1F, there is a separate second stage power means for the upper operating mandrel 88 and a separate second stage power means for the lower operating mandrel assembly 124.

The second stage power means for the lower operating mandrel assembly 124 is the second power piston 134 previously described.

The second stage power means for the upper operating mandrel 88 is a compressed mechanical spring 222 seen in FIGS. 1C-1D. A lower end of compressed mechanical spring 222 engages a shear pin set 224. The shear pin set 224 includes an inner ring 226 which is L-shaped in cross section. Inner ring 226 has a vertical leg carrying a plurality of radial bores 228. One or more shear pins 230 extend through the radial bores 228 into an annular groove 232 defined in the outer surface of upper operating mandrel 88. A square cross section retainer ring 234 holds the shear pins 230 in place within the bores 228. The lower end of compressed mechanical spring 222 actually engages the retainer ring 234.

The shear pins 230 can be generally described as a releasable retaining means 230 for initially retaining the upper operating mandrel 88 against movement from its initial position to its intermediate position, until an upward pressure differential acting across the power piston 104 reaches an operating level at which the shear pins 230 will shear thus releasing the upper operating mandrel 88 and allowing it to move upward relative to housing 12.

It will be appreciated that the compressed mechanical spring 222 provides some resiliency to the manner in which the upper operating mandrel 88 is initially retained against movement by the shear pins 230. Small and brief increases in well annulus pressure can be absorbed by the compressed mechanical spring 222 thus allowing a slight upward motion of the upper operating mandrel 88 without shearing the shear pins 230.

The upper end of compressed mechanical spring 222 engages a lower end 236 of an upper collet ring 238. The upper collet ring 238 has a plurality of radial windows 240 defined therethrough through which are received a plurality of ratchet dogs 242. Two resilient bands 244 bias the dogs 242 radially inward through windows 240. The dogs 242 have ratchet teeth 246 defined thereon which engage outward facing ratchet teeth 248 defined on upper operating mandrel 88.

Extending upwardly from upper collet ring 238 are a plurality of collet fingers 250 each of which carries an enlarged upper head 252.

In the initial position of collet ring 238 as seen in FIG. 1C, a radially outward extending annular flange 254 on upper operating mandrel 88 holds the enlarged diameter heads 252 in engagement with a downwardly facing tapered shoulder 256 defined internally upon the lower outer oil chamber housing section 28. So long as the flange 254 holds the enlarged head 252 in engagement with shoulder 256, the compressed mechanical spring 222 cannot expand.

After the flange 254 moves upward past the enlarged heads 252 of collet ring 238, the compressed mechanical spring 222 will expand thus moving the operating mandrel 88 to its final position due to engagement of ratchet teeth 246 and 248 The expanded mechanical spring 222 as engaged with the upper operating mandrel 88 provides a latching means which latches the upper operating mandrel 88 in its final position.

The ratchet dogs 242 and associated mechanism may generally be described as a ratchet means 242 interconnecting the compressed mechanical spring 222 and the upper operating mandrel 88 for allowing the upper operating mandrel 88 to move from its initial position to an intermediate position while the compressed mechanical spring means 222 remains stationary.

The tool 10 can be generally described as having an operating means comprised of upper operating mandrel 88, lower operating mandrel assembly 124, and the circulating valve port 212 and ball valve 166 associated therewith with the various interrelating structures which tie these operating mandrels and valves together. The circulating valve 212 and the ball valve 166 can each be generally referred to as operating elements which are associated with the operating mandrels 88 and 124, respectively.

The circulating valve defined by valve port 212 in relation to the seals 100 and primary power port 114 can be defined as having an initial closed position as shown in FIG. 1D, and a final open position wherein the upper operating mandrel 88 is moved through its entire travel and the circulating valve port 212 is in registry with the primary power port 114.

The circulating valve port 212 will of course have many intermediate positions between its initial and final position. One of those intermediate positions will be associated with the end of the movement which results directly from power piston 104, and the beginning of the completion of the moving stroke which results from the expansion of the compressed mechanical spring 222. The compressed mechanical spring 222 can be generally described as a second stage power means 222 for moving the upper operating mandrel 88 and the associated circulating valve port 212 from its intermediate position to its final position without further compressing the compressible liquid spring means 122.

With regard to the compressed mechanical spring 222 which provides a second stage power means for the upper operating mandrel 88, the collet ring 238 with the enlarged heads 252 held against shoulder 256 can be generally described as a releasable retaining means for preventing the second stage power means 222 from applying force to the upper operating mandrel 88 to move the upper operating mandrel 88 to its final position until the upper operating mandrel 88 has been moved approximately to its said intermediate position wherein the flange 254 moves past enlarged heads 252 thus allowing the enlarged heads 252 to be cammed inwardly thus allowing compressed mechanical spring 222 to expand.

The ball valve element 166 can be described as having an initial open position as shown in FIG. 1E, and a final closed position where the ball valve element 166 has been rotated through 90° relative to FIG. 1E so that the valve bore 170 is isolated from the housing bore 13 thus closing housing bore 13. The ball valve element 166 will of course have many intermediate positions between that initial and final position. One of those intermediate positions will correspond to the termination of movement resulting from the primary power piston 104, and the beginning of further movement due to the second stage power piston 134.

The second stage power piston 134 can be generally described as a second stage power means 134 for moving the lower operating mandrel assembly 124 and the ball valve element 166 associated therewith from its said intermediate position to its final position without further compressing the compressible liquid means 122.

The collet ring 194 with enlarged heads 200 received in groove 206 can be generally described as a releasable connecting means for connecting the first and second operating mandrels 88 and 124 when they are in their initial position, and for releasing the upper operating mandrel 88 from the lower operating mandrel 124 as they move from their initial position toward their final position.

The primary power piston 104 is preferably designed to have a travel of no more than ¾ to one inch before the collet 238 is released and the spring 222 comes into action, and before the seals 182 move past second stage power port 176 allowing the second stage power piston 134 to come into action.

The tool 10 is preferably constructed so that the ball valve element 166 will completely close before the circulating valve port 212 is placed in communication with well annulus 64 through the primary power port 114.

It will be appreciated that the tool 10 could be modified into a simpler mechanism. For example, the second stage power piston 134 could be utilized to both close the ball valve element 166 and move the upper operating mandrel 88 to its final position, thus allowing the compressed mechanical spring 222 and the associated ratchet mechanism 242 to be eliminated. The second power piston 134 would simply need to be sized to provide sufficient power to operate the entire tool, and the relative travels of the upper operating mandrel 88 and the lower operating mandrel assembly 124 would need to be chosen so that the ball valve element 166 would close before the circulating valve port 212 opened.

The tool just described provides many advantages as compared to tools utilizing a compressed nitrogen gas spring such as U.S. Pat. No. 4,691,779 to McMahan et al., and U. S. Pat. No. 4,311,197 to Hushbeck. Those tools utilizing compressed nitrogen gas require a large number of shear pins as seen for example in FIG. 2B of U.S. Pat. No. 4,311,197. The large number of shear pins is required because the power piston of the tool has its low pressure side referenced to atmospheric pressure. Thus the shear pins must be sufficient to hold the tool against operation when there is a pressure differential across the power piston equal to hydrostatic well annulus pressure plus some additional operating pressure. Problems associated with these shear pins include inconsistent shear values, shear sleeve tolerances which contribute to inaccurate calculations of shearing loads, the inaccuracy of mud weights which are utilized to calculate hydrostatic pressures, and errors due to incorrect pin count. The modified tool disclosed herein greatly reduces and in some cases could entirely replace the shear pins on tools such as that of U.S. Pat. 4,311,197.

The tool 10 is typically designed to be run in a testing string with other annulus pressure responsive tools which normally operate at 2,000 psi plus or minus 500 psi above well annulus pressure. Thus, the shear pins 230 in tool 10 must be sufficient to prevent the tool 10 from operating at the normal 2,000 psi plus or minus 500 psi annulus operating pressures for other tools in the tool string. For example, four to five shear pins 230 could be utilized to lock the tool 10 in place until drill stem testing operations are completed. Then the well annulus pressure can be further raised to shear the pins 230 and operate the safety circulating valve 10 of the present invention.

One optional design which could completely eliminate the shear pins 230 would be to size the differential area power piston 104 and the compressible fluid spring means 122 so that the required operating pressure for moving the power piston 104 would be above the 2,000 psi nominal operating pressure for most other annulus pressure responsive tools.

DESCRIPTION OF OPERATION

When the tool 10 is first run into place within a well, the relatively slow increases in well annulus pressure that occur with increasing depth are metered through the fluid flow restrictor 78 of pressurizing passage 76 of metering cartridge 66 so as to substantially balance well annulus pressure across the first power piston 104.

After the tool 10 is located at its desired operating depth, tool 10 can be actuated by a sufficient relatively rapid increase in well annulus pressure thus creating an upward pressure differential across first power piston 104. This upward force is transferred through shoulder 214 to the upper operating mandrel 88. When the upward force exceeds the retaining force provided by shear pins 230, those shear pins 230 will shear and the upper operating mandrel 88 will begin moving upward relative to housing 12. Due to the interlocking engagement provided by the enlarged heads 200 on the lower collet ring 194, the lower operating mandrel assembly 124 will also be pulled upward relative to housing 12.

This upward movement of the first power piston 104 compresses the compressible silicone oil contained in compressible liquid means 122.

The upward movement of upper operating mandrel 88 causes the ratchet teeth 248 of upper operating mandrel 88 to move upwardly through the ratchet dogs 240 which will remain fixed longitudinally in place until such time as the flange 254 moves upward past the enlarged heads 252 of upper collet ring 238. That occurs at what may be referred to as an intermediate position of the upper operating mandrel 88.

Then, the enlarged heads 252 on upper collet ring can be cammed inwardly due to the upward force exerted by compressed mechanical spring 222. The upward motion of upper collet ring 238 is transferred to the upper operating mandrel 88 due to engagement of ratchet teeth 246 and 248. Thus, the energy provided by compressed mechanical spring 222 is transferred to upper operating mandrel 288 to move it upward to its final position wherein the circulating port 212 will be located above the seals 100 in full registry with the primary power port 114 thus providing for free circulation of well fluid from well annulus 64 to the housing bore 13.

As the force exerted by compressed mechanical spring 222 takes over and moves the upper operating mandrel 88 through the final portion of its stroke, the upper operating mandrel 88 will slide upward relative to the first power piston 104 which can freely slide downward relative to upper operating mandrel 88. The cylindrical outer surface 216 of upper operating mandrel 88 below power transfer shoulder 214 has a length sufficient that the upper operating mandrel 88 can slide freely through the first power piston 104 as the circulating valve port 212 is moved from its intermediate to its final position by the second stage power means 222.

Due to the fact that first power piston 104 slides freely downward relative to upper operating mandrel 88, the first power piston 104 will move the upper operating mandrel 88 only in response to an increase in well annulus pressure and not in response to any subsequent decrease in well annulus pressure.

It will be appreciated that if the primary power piston 104 were utilized to move the upper operating mandrel 88 through its entire stroke so as to move the circulating valve port 212 to a completely open position, that the volume displaced by the first power piston 104 would be substantially greater than the volume displaced by the first power piston 104 in the embodiment illustrated. Thus, the compressible liquid spring means 122 utilized with the tool 10 has a volume much smaller than a volume that would be required to accommodate displacement of the power piston through a distance equal to the entire operating distance of the upper operating mandrel 88 from its initial position to its final position.

Substantially simultaneously with the actions described above, or in some cases slightly prior to the completion of the actions described above, the second power piston 134 will come into play.

Once the second power piston 134 has moved upwardly such that the lowermost sealing ring 182 is above second stage power port 176, the high pressure in well annulus 64 will be communicated with the high pressure side 192 of second power piston 134. The upper side of second power piston 134 is communicated with the housing bore 13, thus the pressure differential which initially exists between well annulus 64 and housing bore 13 will act upwardly across second power piston 134 thus pushing it and the lower operating mandrel assembly 124 upward relative to housing 12.

It will be appreciated that depending upon the design of the tool, the upper end 140 of lower operating mandrel assembly 124 may remain in free abutting engagement with the lower end 92 of upper operating mandrel 88, so that the force acting upwardly across second power piston 134 will also push the operating mandrel 88 upward toward its final position.

When the lower operating mandrel assembly 124 is moved upward sufficiently so that the well annulus 64 first comes into fluid communication with the lower side 192 of second power piston 134, the lower operating mandrel assembly 124 can be said to be in an intermediate position. At approximately that same time, the enlarged heads 200 on lower collet ring 194 will spring outward thus releasing the inner locking engagement between the upper operating mandrel 88 and the lower operating mandrel assembly 124. Further upward motion of lower operating mandrel assembly 124, and thus the final closing motion of spherical ball valve element 166 will be dependent upon the power provided by the second power piston 134.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. An annulus pressure responsive downhole tool apparatus, comprising:

a housing;

a power piston slidably disposed in said housing and having first and second sides;

first and second pressure conducting passage means for communicating a well annulus exterior of said housing with said first and second sides, respectively, of said power piston;

retarding means, disposed in said second pressure conducting passage means, for delaying communication of a sufficient portion of a relatively rapid change in well annulus pressure to said second side of said power piston for a sufficient time to allow a pressure differential across said power piston to move said power piston between a first position and a second position relative to said housing;

compressible liquid means, contained in a first portion of said second pressure conducting passage means between said second side of said power piston and said retarding means, for accommodating displacement of said power piston from its said first position to its said second position;

an operating means disposed in said housing and movable from an initial position to a final position, said operating means being operatively associated with said power piston so that as said power piston moves from its first position to its second position, said operating means is moved from its initial position to an intermediate position between its initial position and its final position; and a second stage power means for moving said operating means from its said intermediate position to its said final position without further compressing said compressible liquid means.

2. The apparatus of claim 1, wherein:

said operating means includes an operating mandrel having a power transfer shoulder defined thereon facing away from said compressible liquid means, said operating mandrel further including a cylindrical outer surface; and said power piston is slidably disposed about said cylindrical outer surface of said operating mandrel and engages said power transfer shoulder as said power piston moves from its said first position to its said second position so that a force acting on said power piston due to a pressure differential thereacross caused by increased well annulus pressure is transferred to said operating mandrel to move said operating means from its said initial position to its said intermediate position.

3. The apparatus of claim 2, wherein said cylindrical outer surface of said operating mandrel has a length sufficient that said operating mandrel can slide freely through said power piston as said operating means is moved from its said intermediate position to its said final position by said second stage power means.

4. The apparatus of claim 1, further comprising:

releasable retaining means for preventing said second stage power means from applying force to said operating means to move said operating means to its said final position until said operating means has been moved approximately to its said intermediate position.

5. The apparatus of claim 1, wherein said power piston is operably associated with said operating means so that said power piston moves said operating means only in response to an increase in well annulus pressure and not in response to any subsequent decrease in well annulus pressure.

6. The apparatus of claim 1, wherein:

said operating means includes an operating mandrel longitudinally movable relative to said housing through an operating distance as said operating means is moved from its said initial position to its said final position; and said first portion of said second pressure conducting passage means containing said compressible liquid means has a volume smaller than a volume that would be required to accommodate displacement of said power piston through a distance equal to said operating distance.

7. The apparatus of claim 1, further comprising:

releasable retaining means for initially retaining said operating means against movement from its said initial position to its said intermediate position, until said pressure differential across said power piston reaches an operating level.

8. The apparatus of claim 7, wherein said retarding means also includes a means for communicating relatively slow changes in well annulus pressure to said second side of said power piston sufficiently quickly that hydrostatic well annulus pressure is substantially balanced across said power piston as said apparatus is run into a well so that said operating level of said pressure differential across said power piston determined by said releasable retaining means is referenced to hydrostatic well annulus pressure.

9. The apparatus of claim 1, further comprising:

latching means for latching said operating means in its said final position.

10. The apparatus of claim 1, wherein said second stage power means comprises:

a second power piston having a high pressure side; and port means for communicating said high pressure side of said second power piston with said well annulus when said operating means reaches its said intermediate position.

11. The apparatus of claim 10, further comprising:

isolation seal means for initially isolating said high pressure side of said second power piston from said port means when said operating means is in its said initial position.

12. The apparatus of claim 11, wherein:

said operating means includes an operating mandrel;

said second power piston is attached to said operating mandrel for movement therewith as said operating means is moved from its initial position toward its final position; and said isolation seal means is carried by said second power piston.

13. The apparatus of claim 10, wherein:

said housing has a housing bore defined therethrough; and said second power piston has a low pressure side communicated with said housing bore.

14. The apparatus of claim 1, wherein said second stage power means comprises:

compressed mechanical spring means for moving said operating means from its said intermediate position to its said final position.

15. The apparatus of claim 14, further comprising:

releasable retaining means for preventing said second stage power means from applying force to said operating means to move said operating means to its said final position until said operating means has been moved approximately to its said intermediate position.

16. The apparatus of claim 14, further comprising:

ratchet means, interconnecting said compressed mechanical spring means and said operating means, for allowing said operating means to move from its said initial position to its said intermediate position while said compressed mechanical spring means remains stationary.

17. The apparatus of claim 1, wherein said operating means comprises:

a flow valve disposed in a housing bore of said housing to control flow of well fluids through said housing bore;

a circulation valve to control communication between said well annulus and said housing bore; and said initial position of said operating means being an open position of said flow valve and a closed position of said circulation valve, and said final position of said operating means being a closed position of said flow valve and an open position of said circulation valve.

18. The apparatus of claim 17, wherein:

said operating means further includes first and second operating mandrels longitudinally movable within said housing to operate said flow valve and said circulation valve, respectively; and said second stage power means includes separate second stage flow valve power means and second stage circulation valve power means for moving said first and second operating mandrels, respectively, to move said flow valve and said circulation valve to their said closed and open positions, respectively.

19. The apparatus of claim 18, wherein said operating means further includes releasable connecting means for connecting said first and second operating mandrels when said operating means is in its initial position and for releasing said first operating mandrel from said second operating mandrel as said operating means moves from its said initial position toward its said final position.

20. An annulus pressure responsive downhole tool apparatus, comprising:

a housing:

an operating assembly including an operating element disposed in said housing, and an operating mandrel slidably disposed in said housing and operably associated with said operating element;

a first power piston slidably disposed in said housing, and operably associated with said operating mandrel and said operating element for moving said operating element relative to said housing by moving said operating mandrel in said first direction relative to said housing, said first power piston having first and second sides;

first and second pressure conducting passage means defined within said housing for communicating a well annulus exterior of said housing with said first and second sides, respectively, of said first power piston;

retarding means, disposed in said second pressure conducting passage means, for delaying communication of a sufficient portion of a change in well annulus pressure to said second side of said first power piston for a sufficient time to allow a pressure differential across said first power piston to move said first power piston in said first direction between a first and a second position relative to said housing and thereby to move said operating mandrel in said first direction;

a second power piston connected to said operating mandrel for movement therewith in said first direction, said second power piston including a high pressure side and a lower pressure side;

port means for communicating said high pressure side of said second power piston with said well annulus to create a pressure differential across said second power piston in said first direction; and isolation seal means for initially isolating said high pressure side of said second power piston from said port means when said first power piston is in its said first position.

21. The apparatus of claim 20, wherein said isolation seal means is carried by said second power piston.

22. A method of operating an annulus pressure responsive downhole tool, comprising:

(a) increasing well annulus pressure;

(b) communicating said increased well annulus pressure to a first side of a power piston of said tool while delaying communication of said increase through a compressible liquid to a second side of said power piston for a sufficient time to allow a pressure differential across said power piston to move said power piston between a first position and a second position within said tool and to thereby move an operating element from an initial position to an intermediate position within said tool;

(c) compressing said compressible liquid by a volume substantially equal to a displacement of said power piston as said power piston moves from its first to its second position and as said operating element correspondingly moves from its initial position to its intermediate position; and (d) moving said operating element from its intermediate position to a final position by means other than said power piston without further compressing said compressible liquid as a result of said moving said operating element from its said intermediate position to its said final position.

23. The method of claim 22, wherein step (d) substantially reduces a necessary volume of said compressible liquid necessary to accommodate movement of said power piston as compared to a tool wherein the entirety of said movement of said operating element is accomplished by means of said power piston.

24. The method of claim 22, wherein step (d) includes moving said operating element from its intermediate position to its final position by means of a second power piston having a low pressure side referenced to a low pressure zone other than said compressible liquid.

25. The method of claim 24, further comprising:

communicating a high pressure side of said second power piston with said well annulus approximately when said operating element reaches its intermediate position.

26. The method of claim 22, wherein step (d) includes moving said operating element from its intermediate position to its final position by expansion of a compressed mechanical compression spring.

* * * * *